US006886758B1

(12) United States Patent
Wieczorek et al.

(10) Patent No.: US 6,886,758 B1
(45) Date of Patent: May 3, 2005

(54) FUEL INJECTOR TEMPERATURE STABILIZING ARRANGEMENT AND METHOD

(75) Inventors: David P. Wieczorek, Seaford, VA (US); John Wesley Phillips, Gloucester Point, VA (US)

(73) Assignee: Siemens VDO Automotive Corp., Auburn Hills, MI (US)

( * ) Notice: Subject to any disclaimer, the term of this patent is extended or adjusted under 35 U.S.C. 154(b) by 0 days.

(21) Appl. No.: 09/482,060

(22) Filed: Jan. 13, 2000

Related U.S. Application Data

(63) Continuation-in-part of application No. 09/259,168, filed on Feb. 26, 1999, now Pat. No. 6,039,272, which is a continuation of application No. 08/795,672, filed on Feb. 6, 1997, now Pat. No. 5,875,972.

(51) Int. Cl.[7] ..... B05B 15/00

(52) U.S. Cl. ..... 239/132.5; 239/497; 239/464; 239/533.12; 239/585.5

(58) Field of Search ..... 239/132, 132.1, 239/132.3, 132.5, 497, 585.1, 585.4, 585.5, 533.12, 464

(56) References Cited

U.S. PATENT DOCUMENTS 1,737,653 A * 12/1929 Gaupp
1,919,904 A * 7/1933 Pielstick
2,273,830 A 2/1942 Brierly et al. ..... 29/157

(Continued)

FOREIGN PATENT DOCUMENTS

DE WO 99/10648 3/1999
DE WO 09910649 A1 3/1999
DE WO 9910649 3/1999
GB 2 140 626 A 4/1984
JP 0241973 9/1990

OTHER PUBLICATIONS

*Geometrical Effects on Flow Characteristics of Gasoline High Pressure Direct Injecter*, W.M. Ren, J. Shen, J.F. Nally Jr., p. 1–7, (97FL–95).

*Primary Examiner*—Christopher Kim

(57) ABSTRACT

A fuel injector having an arrangement to stabilize the temperature of its components within an engine cylinder in a direct injection application. The fuel injector includes a body, an armature, a needle, a swirl generator, and a seat. The body has an inlet portion, an outlet portion, a body passage, extending from the inlet portion to the outlet portion along a longitudinal axis of the fuel injector. The armature is located proximate the inlet portion of the body, and is operatively connected to the needle. The needle is provided with a substantially uniform cross-sectional area, and the body is selected to surround the needle and form a body passage that has an average cross-sectional area less than two times the substantially uniform cross-sectional area of the needle. In particular, the body includes a neck, which is preferably a cylindrical annulus, that has an inner diameter that is no more than 50% greater than a diameter of a preferred cylindrical needle, and an outer diameter that is no less than 100% greater than the inner diameter. The swirl generator is located proximate the needle and the seat. The needle engages the seat, which is disposed at the outlet portion of the body. The seat, preferably, includes a first surface exposed to the body passage and a second surface exposed to an exterior of the fuel injector. The first surface is spaced from the second surface a defined distance along the longitudinal axis. Alternatively, the first surface has at least one cut-out configuration, which is preferably, at least one volume that defines at least one wall that extends from the first surface for a fraction of the defined distance into an interior of the seat.

12 Claims, 3 Drawing Sheets

U.S. PATENT DOCUMENTS 4,120,456 A 10/1978 Kimura et al. ..... 239/464
4,365,746 A * 12/1982 Tanasawa et al. ..... 239/533.12
4,610,080 A * 9/1986 Hensley
4,643,359 A 2/1987 Casey ..... 239/585
4,807,812 A * 2/1989 Renowden et al. ..... 239/132
4,967,959 A * 11/1990 Wieczorek
4,971,254 A * 11/1990 Daly et al. ..... 239/533.12
5,114,077 A 5/1992 Cerny ..... 239/483
5,207,384 A * 5/1993 Horsting ..... 239/585.4
5,271,563 A 12/1993 Cerny ..... 239/533.2
5,409,169 A 4/1995 Saikalis et al. ..... 239/404
5,462,231 A 10/1995 Hall ..... 239/585.4
5,494,224 A 2/1996 Hall et al. ..... 239/585.5
5,625,946 A 5/1997 Wildeson et al. ..... 29/888.41
5,630,400 A 5/1997 Sumida et al. ..... 123/470
5,636,796 A 6/1997 Oguma ..... 239/533.12
5,871,157 A 2/1999 Fukutomi et al. ..... 239/463
5,875,972 A 3/1999 Ren et al. ..... 239/463
5,947,382 A * 9/1999 Kelly ..... 239/127
5,979,801 A * 11/1999 Munezane et al. ..... 239/533.12
6,039,272 A 3/2000 Ren et al. ..... 239/597
6,145,761 A * 11/2000 Muller et al. ..... 239/463

* cited by examiner

FUEL INJECTOR TEMPERATURE STABILIZING ARRANGEMENT AND METHOD

CROSS-REFERENCE TO RELATED APPLICATIONS

This application is a continuation-in-part of U.S. application Ser. No. 09/259,168, filed 26 Feb. 1999, now U.S. Pat. No. 6,039,272; which is a continuation application of U.S. Ser. No. 08/795,672, filed 6 Feb. 1997, now U.S. Pat. No. 5,875,972. This application claims the right of priority to each of the prior applications. Furthermore, each of the prior applications is hereby in their entirety incorporated by reference.

BACKGROUND OF INVENTION

This invention relates to fuel injectors in general and particularly high-pressure direct injection fuel injectors. More particularly to high-pressure direct injection fuel injectors having a body with a seat disposed exposed to the extreme temperatures within the engine cylinder. Experimental testing has shown that these extreme temperatures can effect the operative performance characteristics of the fuel injector. First, the excessive temperatures of the engine cylinder can disproportionately distort the components of the fuel injector within the engine cylinder. For example, the body, which is preferably metal, can be distorted in an unequal quantity from a needle disposed within the body. Distorting of the components of the fuel injector disportionality can, for example, alter the dimensional tolerances between the components of the fuel injector, i.e., the body, the needle, and the seat, which is believed, under certain operative conditions, to render the fuel injector inoperative. Second, the excess temperatures of the engine cylinder can cause the fuel injector to overheat and coke unburned fuel on the components of the fuel injector, i.e., the tip components of the fuel injector, such as, the seat at an outlet portion of the body. Coking of the fuel injector tip components can block the outlet of the fuel injector, which is believed to affect the fuel spray patterns of the fuel injector. Thus, distorting and coking of the fuel injector components utilized in a direct inject application is believed to diminish the performance capability of the fuel injector. Thus, an arrangement of the fuel injector components is needed which minimizes the effects of the temperature within the engine cylinders on the operative performance of the fuel injection.

SUMMARY OF THE INVENTION

The present invention provides a fuel injector having a fuel inlet, a fuel outlet, and a fuel passageway extending from the fuel inlet to the fuel outlet along a longitudinal axis. The fuel injector includes a body, an armature, a needle, a swirl generator, and a valve seat. The body has an inlet portion, an outlet portion, and a body passage extending from the inlet portion to the outlet portion along the longitudinal axis. The armature is located proximate the inlet portion of the body. The armature is operatively connected to a needle. The swirl generator is located proximate the needle and the seat. The needle engages the seat, which is disposed at the outlet portion of the body.

The body includes a neck portion. The neck portion is, preferably, a cylindrical annulus that surrounds the needle. The needle is, preferably, a substantially cylindrical needle. The cylindrical needle is centrally located within the cylindrical annulus. The cylindrical annulus has an inner diameter that is no more than 50% greater than a diameter of the cylindrical needle, and an outer diameter that is no less than 100% greater than the inner diameter.

The seat, preferably, includes a first surface exposed to the body passage and a second surface exposed to an exterior of the fuel injector. The first surface is spaced from the second surface a defined distance along the longitudinal axis. In an alternative embodiment of the seat, the first surface has at least one cut-out configuration that extends from the first surface for a fraction of the defined distance into an interior of the seat. The at least one cut-out, preferable, is at least one volume that defines at least one wall in the interior of the seat.

In a first preferred embodiment of the alternative seat, the at least one volume is a plurality of volumes arranged in the first surface to correspond to a plurality of fuel passage openings in the swirl generator. Each of the plurality of volumes is, preferably, a cylindrical volume having a first diameter, and each of the plurality of fuel passage openings is, preferably, a circular aperture having a second diameter. The first diameter of the cylinder is substantially equal to the second diameter of the circular aperture. The at least one wall defined by each of the cylindrical volumes has a cylinder side wall and a cylinder end wall. The cylinder side wall and the cylinder end wall are located in an interior of the seat.

In a second preferred embodiment of the alternative seat, the at least one volume is a channel arranged in the first surface, which corresponds to the plurality of fuel passage openings. The channel has a width on the first surface that is substantially equal to the diameter of one of the fuel passage openings. Preferably, each of the fuel passage openings has the same diameter. The channel is, preferably, a continuous channel that defines an inner side wall, an outer side wall, and a channel end wall, which engages both the inner side wall and the outer side wall.

The present invention also provides a method of stabilizing temperature of a fuel injector in a direct injection application. The fuel injector has a body; an armature proximate an inlet portion of the body; a needle operatively connected to the armature; a seat disposed at the outlet portion of the body; and a swirl generator proximate the seat. The method is accomplished by providing the needle with a substantially uniform cross-sectional area, and selecting the body to surround the needle and form a body passage that has an average cross-sectional area less than 2.25 times the substantially uniform cross-sectional area of the needle.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT(S)

Figure 1:
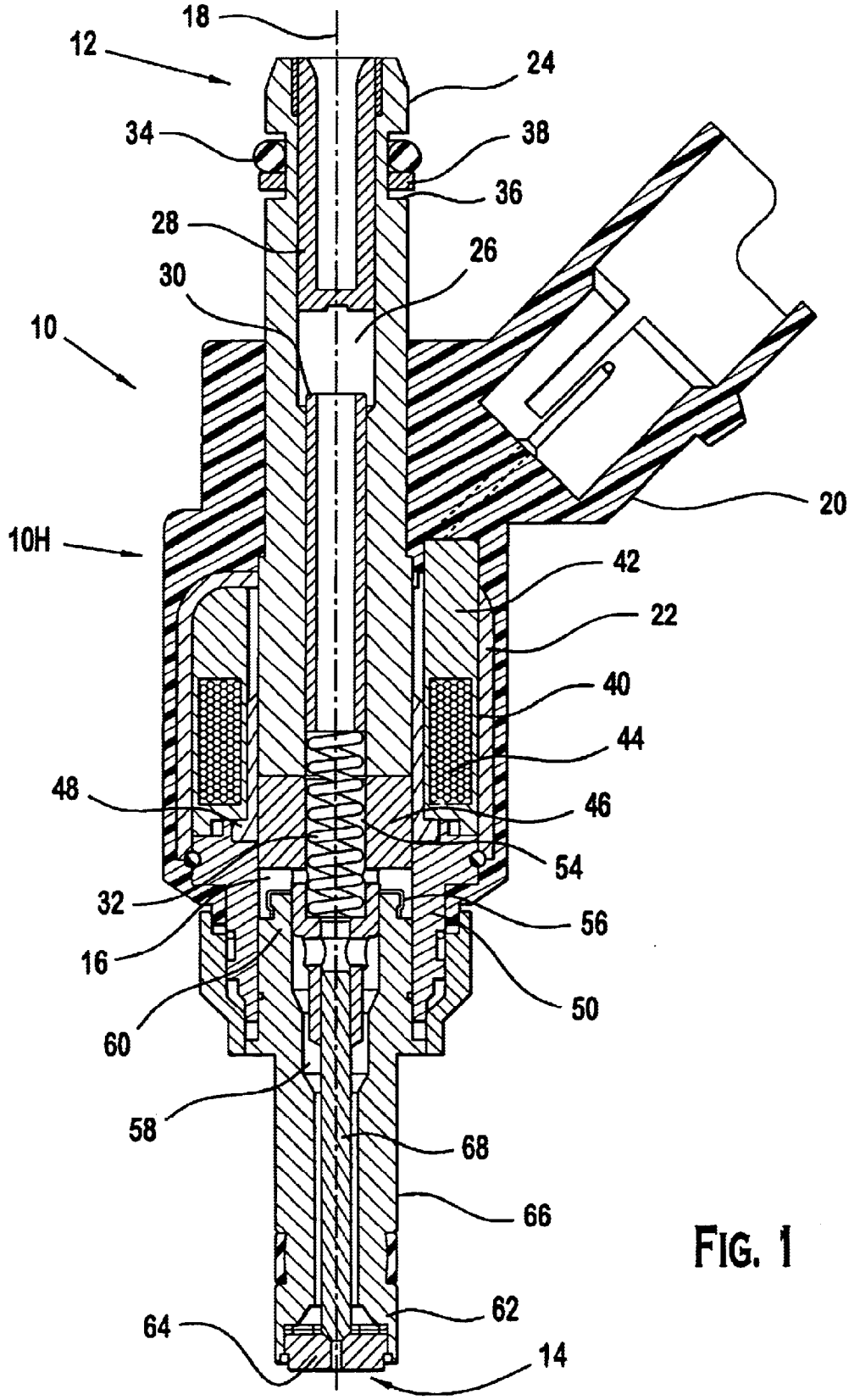
FIG. 1 is a cross-sectional view of a fuel injector of the present invention taken along its longitudinal axis.

FIG. 1 illustrates a preferred embodiment of the fuel injector 10, in particular a high-pressure, direct-injection fuel injector 10. The fuel injector 10 has a housing, which includes a fuel inlet 12, a fuel outlet 14, and a fuel passageway 16 extending from the fuel inlet to the fuel outlet 14 along a longitudinal axis 18. The housing includes an overmolded plastic member 20 cincturing a metallic support member 22.

A fuel inlet member 24 with an inlet passage 26 is disposed within the overmolded plastic member 20. The inlet passage 26 serves as part of the fuel passageway 16 of the fuel injector 10. A fuel filter 28 and an adjustable tube 30 is provided in the inlet passage 26. The adjustable tube 30 is positionable along the longitudinal axis 18 before being secured in place to vary the length of an armature bias spring 32, which controls the quantity of fluid flow from the fuel outlet 14 of the injector 10. The overmolded plastic member 20 also supports a socket that receives a plug (not shown) to operatively connect the fuel injector 10 to an external source of electrical potential, such as an electronic control unit ECU (not shown). An elastomeric o-ring 34 is provided in a groove on an exterior extension of the inlet member. The o-ring 34 is supported by a backing ring 38 to sealingly secure the inlet source with a fuel supply member, such as a fuel rail (not shown).

The metallic support member 22 encloses a coil assembly 40. The coil assembly 40 includes a bobbin 42 that retains a coil 44. The ends of the coil assembly 40 are operatively connected to the socket through the overmolded plastic member 20. An armature 46 is axially aligned with the inlet member by a spacer 48, a body shell 50, and a body 52. The armature 46 has an armature passage 54 aligned along the longitudinal axis 18 with the inlet passage 26 of the inlet member.

The spacer 48 engages the body 52, which is partially disposed within the body shell 50. An armature guide eyelet 56 is located on an inlet portion of the body 60. An axially extending body passage 58 connects the inlet portion of the body 60 with an outlet portion of the body 62. The armature passage 54 of the armature 46 is axial aligned with the body passage 58 of the body 52 along the longitudinal axis 18. A seat 64, which is preferably a metallic material, is located at the outlet portion of the body 62.

The body 52 has a neck portion 66, which is, preferably, a cylindrical annulus that surrounds a needle 68. The needle 68 is operatively connected to the armature 46, and is, preferably, a substantially cylindrical needle 68. The cylindrical needle 68 is centrally located within the cylindrical annulus. The cylindrical needle 68 is axially aligned with the longitudinal axis 18 of the fuel injector 10. The cylindrical annulus of the neck portion 66 has an inner diameter 70 and an outer diameter 72. The inner diameter 70 is, preferably, no more than 50% greater than a diameter 74 of the substantially cylindrical needle 68, and the outer diameter 72 is, preferably, no less than 100% greater than the inner diameter 70.

The relationship between the diameter 74 of the cylindrical needle 68, the inner diameter 70 of the cylindrical annulus, and the outer diameter 72 of the cylindrical annulus provides the cylindrical needle 68 and cylindrical annulus, respectively, with a particular solid mass, which in the preferred embodiment is metal. The physical relationship of the cylindrical needle 68 and the cylindrical annulus are selected so that the body passage 58 assists in stabilizing the temperature of the fuel injector 10 components, and allows fuel flow from fuel inlet to fuel outlet 14 of the fuel injector 10. The metal mass of the cylindrical needle 68 and the cylindrical annulus combined with the fuel in the body passage 58, in addition to the mass of the seat 64, which is also preferably metal, create a thermal mass that distributes the heat that the fuel injector 10 is exposed to within the engine cylinder. It is believed that the temperature of the engine cylinder is more uniformly distributed across the components of the fuel injector 10, i.e., the body 52, the fuel in the body passage 58, the needle 68, and the seat 64, so that the fuel injector 10 withstands the operative temperatures of the cylinder without distorting the dimensional tolerance between the components of the fuel injector 10. By maintaining the dimension tolerance of the fuel injector 10 components, performance operability and reliability of the fuel injector 10 under various operating conditions can be achieved.

Operative performance of the fuel injector 10 is advanced by magnetically coupling the armature 46 to the inlet member near the inlet portion of the body 60. A portion of the inlet member proximate the armature 46 serves as part of the magnetic circuit formed with the armature 46 and coil assembly 40. The armature 46 is guided by the armature guide eyelet 56 and is responsive to an electromagnetic force generated by the coil assembly 40 for axially reciprocating the armature 46 along the longitudinal axis 18 of the fuel injector 10. The electromagnetic force is generated by current flow from the ECU through the coil assembly 40. Movement of the armature 46 also moves the operatively attached needle 68. The needle 68 engages the seat 64, which opens and closes the seat passage 76 of the seat 64 to permit or inhibit, respectively, fuel from exiting the outlet of the fuel injector 10. The needle 68 includes a curved surface 78, which is preferably a spherical surface, that mates with a conical end 80 of a funnel 82 that serves as the preferred seat passage 76 of the seat 64. During operation, fuel flows in fluid communication from the fuel inlet source (not shown) through the fuel inlet passage of the inlet member, the armature passage 54 of the armature 46, the body passage 58 of the body 52, and the seat passage 76 of the seat 64 to be injected from the outlet of the fuel injector 10.

A swirl generator 84 is located in the body passage 58 proximate the seat 64. The swirl generator 84 allows the fuel to form a swirl pattern on the seat 64. In particular, for example, the fuel is swirled on the conical end 80 of the funnel 82 in order to produce a desired spray pattern. The swirl generator, preferably, is constructed from at least one flat disk; however, various configurations of a swirl generator 84 could be employed. The swirl generator, as shown in FIG. 1, includes a pair of flat disks, a guide disk 86 and a swirl disk 88.

Figure 2B:
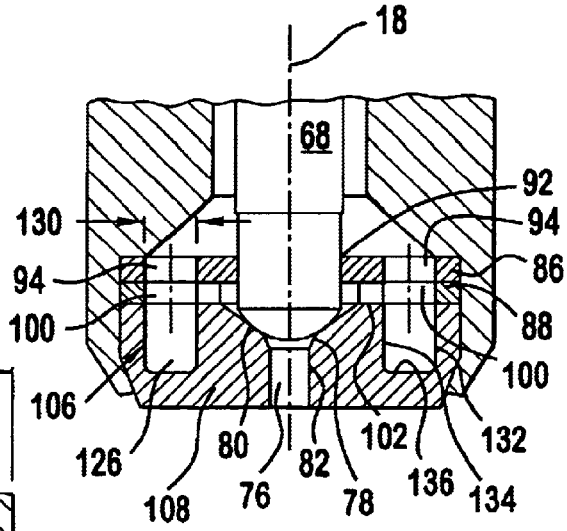
FIG. 2B is an enlarged cross-sectional view of the body of the fuel injector shown in FIG. 1, which illustrates a second alternative embodiment of the seat of the present invention.
Figure 2A:
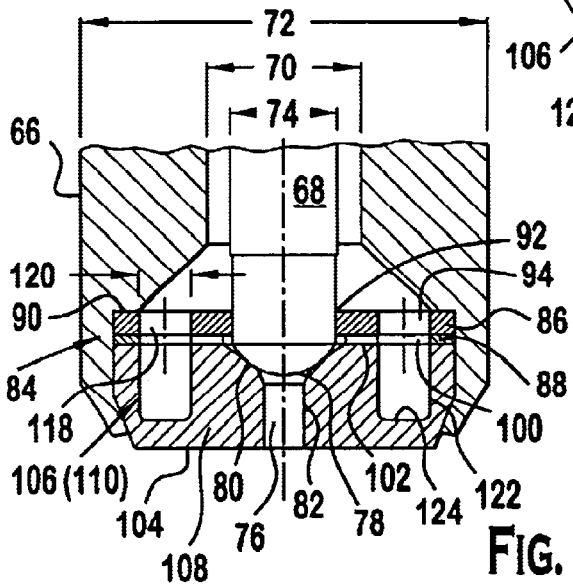
FIG. 2A is an enlarged cross-section; view of the body of the fuel injector shown in FIG. 1, which illustrates a first alternative embodiment of the seat of the present invention.
Figure 4A:
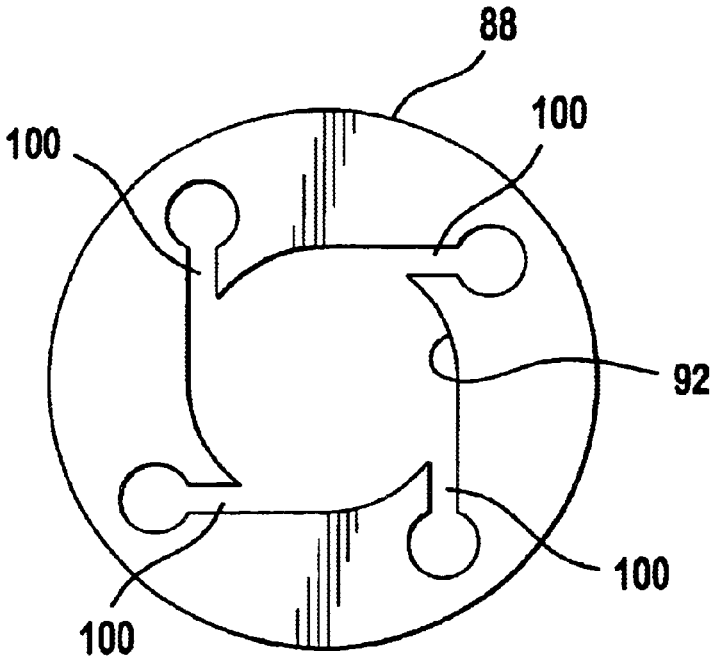
FIG. 4 is a top view of a swirl disk.
FIG. 4B is a top view of the guide disk.
Figure 4B:
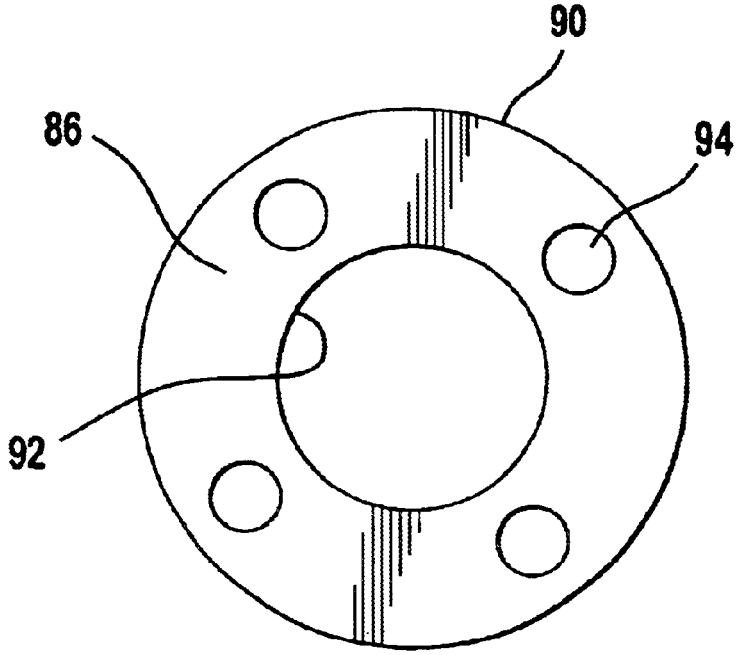

The guide disk 86, as shown in FIGS. 2A, 2B and 4B, has a perimeter 90, a central aperture 92, and a plurality of fuel passage openings 94 between the perimeter 90 and the central aperture 92. The swirl disk 88, as shown in FIGS. 2A, 2B and 4A, has a plurality of slots 100 that corresponds to the plurality of fuel passage openings 94 in the guide disk 86. Each of the slots 100 extends tangentially from the respective fuel passage openings 94 to the central aperture 92.

The needle 68 is guided in the central aperture 92 of the guide disk 86. The plurality of fuel passage openings 94 supply fuel from the body passage 58 to the swirl disk 88.

The swirl disk 88 directs fuel from the fuel passage openings 94 in the guide disk 86 and meters the flow of fuel tangentially toward the seat passage 76 of the seat 64. The guide disk 86 and swirl disk 88 that form the swirl generator 84 are secured to a first surface 102 of the seat 64, preferably, by laser welding.

Figure 3B:
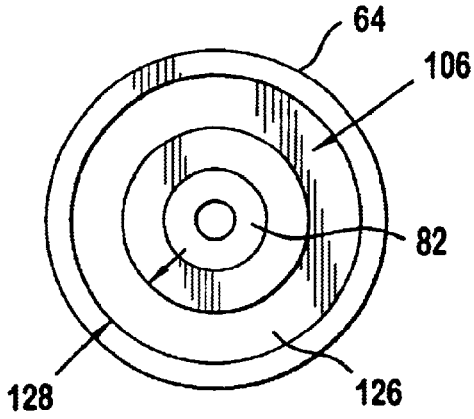
FIG. 3B is a plan view of the seat illustrated in FIG. 2B.
Figure 3A:
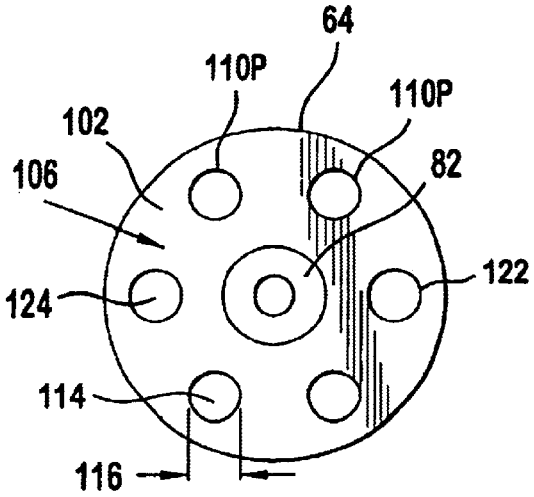
FIG. 3A is a plan view of the seat illustrated in FIG. 2A.

As shown in FIGS. 2A and 3A, the first surface 102 of the seat 64 is directed toward the body passage 58 of the body 52 and a second surface 104 of the seat 64 is exposed to an exterior of the fuel injector 10. The first surface 102 is spaced from the second surface 104 a defined distance along the longitudinal axis 18 of the fuel injector 10. As shown in FIGS. 2B and 3B, the first surface 102, in an alternative embodiment of the seat 64, has at least one cut-out 106 that extends from the first surface 102 for a fraction of the defined distance into an interior of the seat 108. Preferably, the at least one cut-out 106 comprises at least one volume 110 that defines at least one wall 122 in the interior of the seat 108.

The at least one volume 110 within the interior of the body 52 allows for fuel to enter the interior of the seat 108. Because, during operation, the fuel within the fuel injector 10 is typically at a lower temperature than the temperature of the seat 64, the fuel tends to assist in stabilizing the temperature of the components of the fuel injector 10 within the engine cylinder. In particular, the at least one volume 110 allows for the fuel in the fuel passage of the fuel injector 10 to reduce the operative temperature of the seat 64. Lower operative temperatures of the seat 64 are believed to reduce coking of fuel on the second surface 104 of the seat 64.

In a first preferred embodiment, the at least one volume 110 is a plurality of volumes 110P arranged in the first surface 102 to correspond to the plurality of fuel passage openings 94 of the guide disk 86. As illustrated in FIG. 2A, each of the plurality of volumes 110P is, preferably, a cylindrical volume 114 having a first diameter 116, and each of the plurality of fuel passage openings 94 is, preferably, a circular aperture 118 having a second diameter 120. The first diameter 116 of the cylindrical volume 114 is substantially equal to the second diameter 120 of the fuel passage opening in order to maximize fuel flow efficiency.

Each of the cylindrical volumes 114 includes a wall 112 that includes a cylinder side wall 122 and a cylinder end wall 124 in the interior of the seat 108. The cylinder end wall 124 is located between the first surface 102 and the second surface 104 so that fuel in the fuel passageway 16 assists in reducing the operative temperature of the seat 64 during use of the fuel injector 10 in an engine cylinder as compared to a seat 64 without at least one cut-out 106. Preferably, the cylinder end wall 124 is located between the second surface 104 and a midpoint along the defined distance from the first surface 102 and the second surface 104.

In a second preferred alternative embodiment, the at least one volume 110 is a channel 126 arranged in the first surface 102 to correspond to the plurality of fuel passage openings 94. The channel 126 has a width 128 on the first surface 102, and each of the plurality of fuel passage openings 94 is, preferably, a circular aperture 118 with a diameter 130. The diameter 130 of one of the fuel passage openings 94 is substantially equal to the width 128 of the channel 126. The channel 126 is, preferably, a continuous channel 126, such as the circular channel illustrated in FIG. 3B. The continuous channel 126 defines an inner side wall 132, an outer side wall 134, and a channel end wall 136. The channel end wall 136 engages both the inner side wall 132 and the outer side wall 134.

The inner side wall 132, the outer side wall 134, and the channel end wall 136 can have various configurations. For example, as shown in FIGS. 2B and 3B, the preferred embodiment has an inner side wall 132 and an outer side wall 134 are substantially parallel to the longitudinal axis 18 of the fuel injector 10, and the channel end wall 136 is substantially perpendicular to the inner side wall 132 and the outer side wall 134. Alternatively, the channel end wall 136 could have a parabolic cross-section that connects to substantially parallel or non-parallel inner and outer side walls 134.

The channel end wall 136 extends into the interior of the seat 108 so that fuel in the fuel passageway 16 assists in reducing the seat 64 temperature during use of the fuel injector 10 in an engine cylinder. Preferably, the channel end wall 136 is located between the second surface 104 and a midpoint along the defined distance from the first surface 102 and the second surface 104.

The present invention also provides a method of stabilizing temperature of a fuel injector 10 in a direct injection application. The fuel injector 10 has a body 52; an armature 46 proximate an inlet portion of the body 60; a needle 68 operatively connected to the armature 46; a seat 64 disposed at the outlet of the body 52; and a swirl generator 84 proximate the seat 64. The method is accomplished by providing the needle 68 with a substantially uniform cross-sectional area, and selecting the body 52 to surround the needle 68 and to form a body passage 58 proximate the needle 68 that has an average cross-sectional area less than 2.25 times the substantially uniform cross-sectional area of the needle 68. The body passage 58 forms part of the fuel passageway 16 of the fuel injector 10.

In a preferred embodiment of the method, a substantially cylindrical member is provided as the needle 68 and a cylindrical annulus is provided as part of the body 52 to form the body passage 58. The cylindrical annulus has an inner diameter 70 that is no more than 50% greater than a substantially uniform diameter of the substantially cylindrical needle 74, and an outer diameter 72 that is no less than 100% greater than the inner diameter 70. The seat 64 has a first surface 102 exposed to the fuel passageway 16 and a second surface 104 exposed to an exterior of the fuel injector 10, and at least one cut-out 106 is configured in the first surface 102 to form a wall 112 that extends for a fraction of the defined distance into an interior of seat 108. As an example according to the present invention, the diameter of a needle can be 2.085 millimeters, the inner diameter of the valve body can be 3.00 millimeters, and the outer diameter of the valve body can be 7.68 millimeters.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What we claimed is:

1. A direct injection fuel injector having a fuel inlet, a fuel outlet, and a fuel passageway extending from the fuel inlet to the fuel outlet along a longitudinal axis, the fuel injector comprising:

a body having an inlet portion, an outlet portion, a neck portion disposed between the inlet portion and the outlet portion, the neck portion including a metallic cylindrical annulus that provides a body passage extending from the inlet portion to the outlet portion along the longitudinal axis of the fuel injector;

an armature proximate the inlet portion of the body;

a cylindrical needle operatively connected to the armature;

a seat disposed at the outlet portion of the body, the seat having a passageway providing a fuel distribution outlet through the passageway, the seat including a circumferential portion disposed within the body and directly connected to the interior surface of the body so that the circumferential portion extending along the longitudinal axis within the body is contiguous to the interior surface; and a swirl generator proximate the seat, the swirl generator having a guide disk contiguous to a flat disk, each of the guide disk and flat disk having a first surface generally parallel to a second surface extending from an outer perimeter to a central aperture of respective disks, the flat disk having a central aperture and an equal number of apertures axially in-line with apertures angularly spaced in the guide disk and having a slot means extending from each of said angularly spaced apertures tangentially to said central aperture so that the seat with the swirl generator forms an assembly welded to the body as fuel flows through the apertures in the guide disk and is metered and directed in a tangential direction to the central aperture in the flat disk;

wherein the cylindrical annulus of the body includes an inner diameter that is greater than a diameter of the cylindrical needle so as to define the body passage, which maintains an operative relationship between the body and the needle when the body is exposed to operating temperatures of a cylinder of an engine.

2. The fuel injector of claim 1, wherein the inner diameter of the cylindrical annulus is no more than 50% greater than the diameter of the cylindrical needle, and an outer diameter of the cylindrical annulus is no less than 100% greater than the inner diameter of the cylindrical annulus.

3. A fuel injector having a fuel inlet, a fuel outlet, and a fuel passageway extending from the fuel inlet to the fuel outlet along a longitudinal axis, the fuel injector comprising:

a body having an inlet portion, an outlet portion, and a body passage extending from the inlet portion to the outlet portion along the longitudinal axis;

an armature proximate the inlet portion of the body;

a needle operatively connected to the armature, the needle includes a curved surface that engages with a conical end of the funnel to inhibit fuel flow through the seat passage of the seat;

a swirl generator proximate the needle, the swirl generator comprises at least one flat disk, the at least one flat disk includes:

a guide disk having a perimeter, a central aperture, and at least one fuel passage opening between the perimeter and the central aperture; and a swirl disk having at least one slot extending radially from the at least one fuel passage opening to the central aperture so that a portion of the slot is tangential to the central aperture;

a seat protruding from the outlet portion of said body, the seat including a first surface exposed to the body passage and a second surface exposed to an exterior of the fuel injector, the first surface being spaced from the second surface a defined distance along the longitudinal axis, the first portion having at least one cut-out configuration that extends from the first surface for a fraction of the defined distance into an interior of seat wherein the at least one cut-out comprises at least one volume that defines at least one wall in the interior of the seat, the at least one volume comprises one of a plurality of volumes and a channel, wherein the seat includes a seat passage, the seat passage including a funnel extending between the first surface and the second surface.

4. The fuel injector of claim 3, wherein the at least one fuel passage opening comprises a plurality of fuel passage openings between the perimeter and the central aperture; and the at least one slot of the swirl disk comprises a plurality of slots that corresponds to the plurality of fuel passage openings in the guide disk.

5. The fuel injector of claim 4, wherein the at least one volume comprises a plurality of volumes arranged in the first surface to correspond to the plurality of fuel passage openings.

6. The fuel injector of claim 5, wherein each of the plurality of volumes comprises a cylindrical volume having a first diameter, and wherein the each of the plurality of fuel passage openings comprises a circular aperture having a second diameter, the first diameter being substantially equal to the second diameter.

7. The fuel injector of claim 6, wherein the at least one wall defined by each of the cylindrical volumes comprises a cylinder side wall and a cylinder end wall in the interior of the seat.

8. The fuel injector of claim 7, wherein the cylinder end wall is located between the second surface and a midpoint along the define distance from the first surface and the second surface.

9. The fuel injector of claim 3, wherein the channel comprises a width on the first surface, and wherein each of the plurality of fuel passage openings comprises a circular aperture with a diameter, the diameter of one of the fuel passage openings being substantially equal to the width of the channel.

10. The fuel injector of claim 9, wherein the channel comprises a continuous channel, and wherein the at least one wall defined by the continuous channel comprises an inner side wall, an outer side wall, and a channel end wall engaging both the inner side wall and the outer side wall.

11. The fuel injector of claim 10, wherein the channel end wall is located between the second surface and a midpoint along the define distance from the first surface and the second surface.

12. The fuel injector of claim 3, wherein the body comprises a neck portion, the neck portion including a cylindrical annulus that surrounds the needle, the needle being a substantially cylindrical needle; and wherein the cylindrical annulus comprises an inner diameter and an outer diameter, the inner diameter that is no more than 50% greater than a diameter of the cylindrical needle, and an outer diameter that is no less than 100% greater than the inner diameter.

* * * * *